US007278665B2

(12) United States Patent
Rogatnev

(10) Patent No.: US 7,278,665 B2
(45) Date of Patent: Oct. 9, 2007

(54) FLEXIBLE LOCKING AND SEALING DEVICE

(76) Inventor: Nikolay Timofeevich Rogatnev, Post Box 1, Moscow 109382 (RU)

( * ) Notice: Subject to any disclaimer, the term of this patent is extended or adjusted under 35 U.S.C. 154(b) by 358 days.

(21) Appl. No.: 10/495,048

(22) PCT Filed: Nov. 1, 2002

(86) PCT No.: PCT/RU02/00478

§ 371 (c)(1),
(2), (4) Date: May 6, 2004

(87) PCT Pub. No.: WO2003/040497

PCT Pub. Date: May 15, 2007

(65) Prior Publication Data

US 2004/0256865 A1 Dec. 23, 2004

(30) Foreign Application Priority Data

Nov. 6, 2001 (RU) ..... 2001129785
Dec. 27, 2001 (RU) ..... 2001135235

(51) Int. Cl.
*B65D 27/30* (2006.01)
*B65D 33/34* (2006.01)

(52) U.S. Cl. ..... 292/307 R; 292/319; 292/317

(58) Field of Classification Search ..... 292/307 R, 292/319 X, 315, 317 X, 320, 323; 70/16, 70/14, 18, 19, 30, 49, 38 R, 38 A, 38 B, 70/38 C, 39; 403/61, 64, 325, 374.1, 409.1

See application file for complete search history.

(56) References Cited

U.S. PATENT DOCUMENTS 15,290 A * 7/1856 Kemper ..... 28/125
1,271,912 A * 7/1918 Kemper ..... 403/384
3,770,307 A 11/1973 Van Gompel (Continued)

FOREIGN PATENT DOCUMENTS

DE 443250 5/1927

(Continued)

*Primary Examiner*—Suzanne Dino Barrett
*Assistant Examiner*—Mark Williams
(74) *Attorney, Agent, or Firm*—Collard & Roe, P.C.

(57) ABSTRACT

The invention is used for locking and sealing railway wagons and containers, warehouses, shops, stalls etc. The invention makes it possible to increase the locking reliability by means of a small, easy-touse device. The inventive device comprises a part of wire rope whose one end passes through a body and is fixed with the aid of two spring-loaded rollers during a locking operation. The external side surface of each roller has a spiral or dentate shape and is formed by successively disposed collars and annular grooves. Each roller together with the spring thereof and a pusher is arranged inside the body on a separate mounting seat which is embodied in the form of a longitudinal slot whose width corresponds to the diameter of the roller. The slots are disposed at an angle with respect to each other and the longitudinal axis of the end-to-end channel of the body. The slots are provided with end cylindrical stop surfaces which are oriented towards the input hole of the body and offset with respect to each other. Several variants for the arrangement of the rollers inside the body and with respect to each other are also disclosed.

35 Claims, 7 Drawing Sheets

U.S. PATENT DOCUMENTS

Figure 1A:
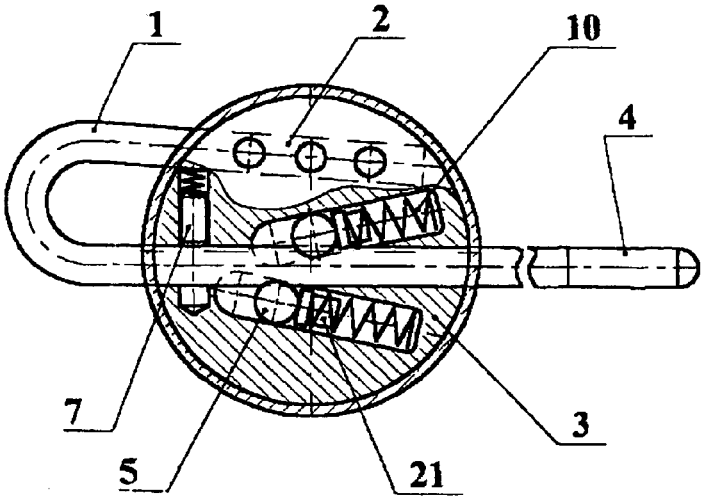

| | | | | | |
|---|---|---|---|---|---|
| 3,994,521 | A * | 11/1976 | Van Gompel | 292/319 |
| 4,141,117 | A * | 2/1979 | Van Gompel | 24/136 R |
| 4,640,538 | A * | 2/1987 | Brammall | 292/323 |
| 5,359,870 | A * | 11/1994 | Reutlinger | 70/456 R |
| 5,820,176 | A * | 10/1998 | Leon et al. | 292/323 |
| 6,345,847 | B1 * | 2/2002 | Dreisbach et al. | 292/323 |
| 6,719,335 | B2 * | 4/2004 | Velschou et al. | 292/307 R |
| 7,021,091 | B2 * | 4/2006 | Leyden et al. | 70/18 |

FOREIGN PATENT DOCUMENTS

| | | |
|---|---|---|
| EP | 0861994 | 9/1998 |
| RU | 2109185 | 4/1998 |
| RU | 2121090 | 10/1998 |
| RU | 2126106 | 2/1999 |
| RU | 2144155 | 1/2000 |
| RU | 214 9297 | 5/2000 |

* cited by examiner

FLEXIBLE LOCKING AND SEALING DEVICE

CROSS REFERENCE TO RELATED APPLICATIONS

Applicant claims priority under 35 U.S.C. §119 of Russian Applications Nos. RU 2001129785 filed on Nov. 6, 2001 and RU 200135235 filed on Dec. 27, 2001. Applicant also claims priority under 35 U.S.C. §365 of PCT/RU02/00478 filed on NOV. 1, 2002. The international application under PCT article 21(2) was not published in English.

TECHNICAL FIELD

The invention is used for locking and sealing railway wagons and containers, warehouses, shops, stalls etc.

BACKGROUND ART

From the prior art there are known flexible locking and sealing devices, described in patents RU 2121090 C1, Feb. 9, 1998, F 16G 11/04, RU 2126106 C1, 27 Oct. 1998, F16G 11/04, RU 2144155 C1, Oct. 1, 2000, F16G 11/04, RU 2149297 C1, Oct. 5, 2000, F16G 11/04. These known flexible locking and sealing devices comprise a wire rope cut which is fixed in a body during a locking operation by spring-loaded fixing elements. In these known devices the body can be flat, can have a thin-walled cover and a cap made fast to the body thus forming permanent construction. The fixing elements can be made as the rollers interacting with a side surface of a wire rope cut by their side surfaces. It is suggested to provide the devices with a controller for holding the rollers in their mounting seats in the device initial position, prepared for locking, and with a fixing arm with a pusher. The necessary sealing information can be applied to the flat end surfaces of the body, or the cover, and/or the cap.

From the prior art it is known a flexible locking and sealing device described in EP 0861994 A2, Feb. 9, 1998, F16G 11/14. The known device comprises a housing wherein beforehand one end of a cable is secured and when locking the second end passes through the housing forming a loop and is fixed by two spring-loaded steel balls with different diameters, disposed inside the housing in a special mounting seat. The balls each uniformly stress the cable to spread the stress of the wedding action. This reduces stress concentration on the cable so that the cable fails only at its maximum tensile load.

These known devices have common disadvantage connected with the fact that they don't prevent reverse withdrawal of the rope cut with criminal intention, which decreases the reliability of the devices and consequently their protective qualities. Besides, the increase in force characteristics of such known devices is connected with the increase in their dimensions thus decreasing performances and increasing their cost. From the prior art it is known a flexible locking sealing device described in U.S. Pat. No. 3,994,521, 30 Nov. 1976, F16G 11/04. In this known device it is also used a cut of a cable, one end of which is rigidly fixed in a housing. There is a shell in the housing with the elements fixing the second free end of the cable. The fixing elements are made in the form of the balls and disposed in the seating places of the shell; when locking they move along the inner conical surface of the housing. The use of the balls as the elements fixing the cable cut doesn't provide the high forces of closure. When the device is locked, the cable cut can turn over in the housing, which loosens the lock and can cause its criminal opening, the fact of which can be easily concealed since the opened device is reusable.

It is known a flexible locking and sealing device described in DE patent 443250, Jun. 4, 1995, F 16 G 11/04. For locking in this device it is used a cable cut, one end of which is rigidly fixed in a housing. The housing has the means for fixing when locking a second free end of the cable cut, namely a ball and a conical surface of a shell. The device has the following disadvantages: in a locked state the cable cut can turn over in the housing, which loosens the lock and can cause its criminal opening. After its criminal opening the lock is easily reusable which allows to conceal the fact of its criminal opening. The errors in the manufacture of separate matching parts of the device effect on the accuracy of its locking which allows to speak about its unreliability. Besides, said known device is not good in practice since it has a bulky construction requiring the presence of two parts for locking.

It is known a flexible locking sealing device described in U.S. Pat. No. 3,770,307, F 16 G 11/04, comprising a cable cut, one end of which is rigidly fixed in a housing, wherein the elements for the other free end fixation are disposed. The housing has a through channel, the size of which allows the passing of the cable cut free end through this channel with the forming of a loop. The fixing elements disposed in the housing are made in the form of a wedge and a wedging out element in the form of a disk. The wedge has an inclined surface disposed at a small angle with respect to the through channel of the housing and at a small distance from it. The wedging out element is frictionally conjugated with the inclined surface and the cable cut. So during the locking operation the movement of the cable cut through this channel in one direction causes the movement of the wedging out element outside, and the movement of the cable cut in opposite direction causes the movement of the wedging out element to the cable cut. Thus the cable cut is wedged between the channel walls and the wedging out element so that its further movement in this direction becomes impossible. This known device has the disadvantages connected with its deficient reliability. Thus, in locked state the cable cut in the housing can turn over which can lead to its criminal opening. The housing of this device has such construction that it can be subject to deformation and it can be easily opened by improvized instruments in case of criminal action. The reliability of locking of this known device depends on the accuracy of the manufacture of its conjugated elements. It is also known a flexible locking sealing device described in RU 2109185, F 16 G 11/04. The known flexible locking sealing device comprises a cable cut, one end of which is rigidly fixed to a tip having a flat form, and the other end during the locking operation passes through a hole and forms a loop, the hole being made in the flat tip, then it passes through a housing and is fixed by fixing elements made in the form of the disks. The disks are disposed in the mounting seats of a shell which in turn is disposed inside the housing and is spring-loaded. The housing of the known device is made in the form of a cup and has a plug permanently fastened together. In the bottom of the housing and in the plug the through holes are made for passing the cable cut when locking. The necessary sealing information is applied to the flat surface of the tip. The housing is heat-treated. The known device is more reliable due to high locking forces. It is easily producible, is universal in use since it is possible to use the cable cuts of different diameters in the same housing. But this known device has some disadvantages. Thus, the disposition of the cap on the opened side of the housing, i.e. on the side of its exit hole, allows its criminal opening, after which the subsequent locking is possible. And it is impossible to monitor and to check the fact of such criminal action, which decreases the protection properties and the reliability of such device. Besides, in said known device the possibility to manipulate the rollers during criminal action by sharp objects is not excluded, when the rollers fall out of the mounting seats of the shell, thus making the device prepared for locking defective, and it is not always possible to detect such malfunction. This also decreases the protection properties of the device and its reliability.

All these known devices are considered to be the closest prior art for the claimed invention and the claim is formulated taking them into account but not in two-part form (without the division into the limiting and distinctive parts).

DISCLOSURE OF THE INVENTION

The technical result consists in the increase in reliability in combination with minimal dimensions of flexible locking sealing devices and increase in convenience.

The technical result of the invention according to the first embodiment is provided by that a flexible locking sealing device comprises a cut of wire rope whose one end is beforehand rigidly fastened to a body and the second free end during a locking operation passes through the body forming a loop and is fixed there by two identical spring-loaded rollers. The body has a flat form and there is a through channel on the side of its side surface for the location of the part of the second free end of the wire rope cut. The diameter of each roller is greater than the diameter of the wire rope cut. The external side surface of each roller is toothing and is formed by alternate annular collars and grooves. Each roller together with the spring thereof is arranged inside the body on a separate mounting seat. Each mounting seat for the rollers is made in the form of a longitudinal slot whose width corresponds to the diameter of the roller, said slots and the longitudinal axes of the slots for the rollers are disposed at an angle with respect to each other and to the longitudinal axis of the through channel of the body. The slots for the rollers have stop end cylindrical surfaces which are oriented towards the input hole of the body and offset with respect to each other.

An angle at which the longitudinal axis of the slot for the roller closest to the input hole of the body is disposed can be greater than an angle at which the longitudinal axis of the slot for the second roller is disposed.

An angle at which the longitudinal axis of the slot for the roller closest to the input hole of the body is disposed can be less than an angle at which the longitudinal axis of the slot for the second roller is disposed.

The angles at which the longitudinal axes of the slots for the rollers are disposed with respect to the longitudinal axis of the through channel of the body can be equal.

The longitudinal axis of the part of one of the slots for the rollers or of the part of each longitudinal slot for the rollers having stop end cylindrical surface can be disposed at an angle with respect to the longitudinal axis of the rest part of the longitudinal slot for the rollers.

The length of the part of the longitudinal slot for a roller with stop end cylindrical surface disposed at an angle with respect to the rest part of this longitudinal slot is selected for combination of a maximal roller force on a wire rope cut with the minimal body dimensions.

The stop end cylindrical surfaces of the slots in the body for the rollers which are oriented towards the input hole of the body are offset with respect to each other for a distance providing a specified curvature radius of a wire rope cut part in the body during the locking.

The device can be additionally provided with a controller intended for holding the rollers in the mounting seats when assembling the device and its pre-starting procedure. The controller is made in the form of an oblong body, the diameter of which corresponds to the diameter of the wire rope cut, and its length—to the length of the through channel of the body. The controller can be made from plastic.

Alternate annular collars and grooves of toothing side surface of the rollers can have a triangle form in cross-section. The edges of alternate annular collars and grooves should preferably be sharpened. The beginning and the end of the side surface of the rollers should preferably be formed by the bottom of the teeth grooves. The longitudinal axis of alternate annular collars and grooves forming the toothing side surface of a roller should coincide with the longitudinal axis of the roller. The direction of the teeth cutting on the external side surface of the rollers may not coincide with the direction of twisting of the wire rope cut arms. The direction of teeth cutting on the external side surface of the rollers can coincide with the direction of the wire rope cut arms.

The device can be provided with a cover made fast to the body and forming a one-piece construction.

The device can be provided with a thin-walled jacket and a cover made fast to the body and forming a one-piece construction.

The device can be provided only with a thin-walled jacket, without a cover, made fast to the body and forming a one-piece construction.

The necessary sealing information can be applied to the flat end surfaces of the body and/or a jacket, and/or a cover.

The flat end surfaces of the body should preferably be parallel.

At cross-section the body can have the form of a circle, or an oval, or a polygon.

The device can be provided with the spring-loaded stopper disposed inside the body and able to act on the side surface of the wire rope cut which is inside the body in locked state of the device and able to close the through channel of the body in case of withdrawal of the wire rope cut from the body. The mounting seat for the spring-loaded stopper is made as a: blind groove on the side of the side surface of the body, cutting across the through channel of the body. In locked state of the device and in a state, prepared for locking, the spring-loaded stopper is disposed in the body between the end of the wire rope, beforehand rigidly fixed in the body, and the part of the wire rope cut, disposed in the body when locking.

The device can be additionally provided with two pushers each disposed in a longitudinal slot for the roller and interacting with the side surface of the roller on the one side and with the spring-loading spring on the other side.

The technical result of the invention according to the second embodiment is provided by that a flexible locking sealing device comprises a wire rope cut which when locking passes through a channel of the body and is fixed there by some spring-loaded rollers, disposed in the mounting seats provided in the body; said rollers interact with a side surface of the wire rope cut when locking by own side surfaces. The mounting seats for the rollers are made in the form of two longitudinal slots, disposed on two diametrically opposite sides of the body's through channel and are able to communicate with the space of the body's through channel; said slots have stop end surfaces which are offset for a certain distance with respect to each other and to the input hole of the body. Both slots are inclined towards the body's through channel and the angles of inclination are oriented towards the input hole of the body. The spring-loaded rollers are disposed in the slots and are able to rotate when moving along the slots during a locking operation and able to come up against the stop end surface of the slots by their side surfaces during criminal attempt of reverse withdrawal of the wire rope cut from the body. And the side surfaces of one slot, the stop end surface of which is disposed farther then the input hole of the body, are made flat, rectilinear and parallel to each other. The side surfaces of the other slot, the stop end surface of which is disposed closer to the input hole of the body are made flat and consist from two parts, so that one part of said slot having the stop end surface is disposed at a greater angle with respect to the through channel of the body than the second part of said slot. And, the external side surface of each roller is made either in the form of a spiral surface or is formed by alternate annular sharpened collars and grooves, the planes of cross-section of which are parallel to each other and inclined towards the longitudinal axis of the roller. Besides, the device is provided with two pushers each disposed in the slot for the rollers and interacting with the side surface of corresponding roller on the one side and with the roller spring-loading spring on the other side. The device is also provided with a controller which is made in the form of a cylindrical body, one end of which is sharpened.

The slots for the rollers are made opened on one end surface of the body.

The number of rollers is selected from expression <<n+1>>, where n≧1.

The diameter of each roller corresponds to the diameter of the wire rope cut or is greater than this diameter.

In the case of the device with three rollers, two of them are arranged in different slots, are disposed opposite each other so that the plane passing through the central axes of both rollers is perpendicular to the longitudinal axis of the through channel of the body.

It is possible that two rollers disposed opposite each other in different slots have an equal diameter, and the diameter of the third roller which interacts by its side surface with the stop end surface of the slot disposed closer to the input hole of the body is less than the diameter of these two rollers, or the diameters of all three rollers are equal.

It is possible to make the device in such a way that one end of the wire rope cut is beforehand rigidly fixed inside the body and the second free end of the wire cut is intended for passing through the channel of the body during a locking operation and fixing by means of the rollers disposed in the body.

It is possibl that one end of the wire rope cut which is not intended for fixing inside the body when locking is provided with a tip having a head with a flat end surface. There is an annular groove on the external surface of the tip close to its head. This annular groove is intended for the location of a split ring. In the case of using the device for locking <<in line>> the head of the tip may be used as a sealing element, i.e, a place for applying the necessary sealing information may be provided on the head.

In the case of using the device for locking with forming a loop the tip with the wire rope cut end fixed therein is disposed inside the body. The body is provided with a through hole for the placement of the tip with the wire rope cut, the longitudinal axis of this through hole being perpendicular to the longitudinal axis of a through channel of the body. In order to prevent the turning over of the tip inside the body the tip in its cross-section has a form of a polygon similar to the form of the through hole in the body where it is placed.

It is possible in the case of using the device for locking with forming the loop a part of the one end of the wire rope cut not intended for fixing when locking inside the body, is beforehand rigidly fixed inside the body so that the longitudinal axis of this part of the wire rope cut and the longitudinal axis of the through channel of the body are arranged in one plane and are parallel to each other or are located at an angle to one another.

The angles of inclination of both slots with respect to the through channel of the body may be equal or different.

Preferably, the diameter of the controller's oblong body corresponds to the diameter of the wire rope cut or would be less than this and the length of the controller must correspond to the length of the through channel of the body. For facilitating the separation the cap of the controller is connected with its cylindrical body by means of thin-walled cross pieces formed by means of the slots made between the cap and the cylindrical body of the controller. The cap of the controller is made so that it is possible to apply to it the necessary sealing information and is intended for enclosure to report of sunctioned opening.

The edges of the spiral collars on the external surface of the rollers can be sharpened.

The mechanical dimensions of the elements of the device are calculated and selected so that in a locked state of the device at least one roller would be able to enter the wire rope cut to a depth of not less than a half of its diameter.

Preferably, the body of the device is flat.

Preferably, the end surfaces of the longitudinal slots for the rollers are offset with respect to each other within the distance corresponding to the rollers diameter or less.

The device may be provided with a thin-walled jacket which is made fast to the-body.

The device may be provided with a thin-walled cover and a cap, protecting the body.

The device may have no cover, in that case it is provided only with the cap, closing the body.

The place for applying the necessary sealing information may be provided on external surface of the thin-walled jacket, and/or on external surface of the cover, and/or on the surface of a controller's cap, and/or on the tip head.

On the free end of the wire rope cut, which is intended for passing through the body when locking, a sharpened cap may be fixed, which fixes the individual strands of the wire rope cut and wires from untwisting.

The longitudinal axis of a part of a slot disposed farther from the input hole of the body and having the stop end surface, is disposed at an angle to the longitudinal axis of the other part of this slot, and this angle is less than an angle at which the other part of this slot is arranged with respect to the longitudinal axis of the through channel of the body.

The places of communication of the slots for the rollers with the through channel of the body are located in close proximity to stop end surfaces of the slots.

The rollers are arranged in the slots of the body so that their rotation axes are parallel to each other and are perpendicular to the longitudinal axis of the through channel of the body.

The bottom surface of the slots for the rollers is flat.

Inside the body on the side of its input hole a ring-shaped element can be disposed intended to prevent a criminal penetration into the body for example, by sharpened subjects (tools); and this ring-shaped element is made from a material with the increased hardness, and its internal diameter is selected depending on the wire rope cut diameter providing the minimum clearance.

In order to facilitate the manufacture technology of the body the slots for the rollers are made opened on the side of the side surface of the body.

For increase in stroke of the spring with the pusher, the end surfaces of the slots for the rollers opposite to their stop end surfaces are made curvilinear.

The pitch of the spiral thread or the pitch of the ring-shaped collars on the side surface of the rollers may correspond to the diameter of the individual wires in the strands of the wire rope cut.

The second end of the controller can have a cap, able to be easily separate from the cylindrical body of the controller.

THE SHORT DESCRIPTION OF THE DRAWINGS

The invention is made clear by the drawings where on

Figure 1B:
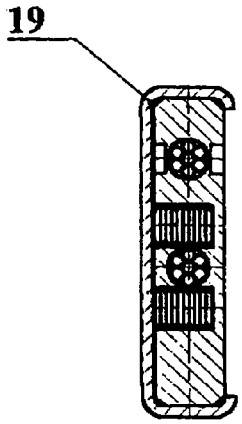
Figure 3A:
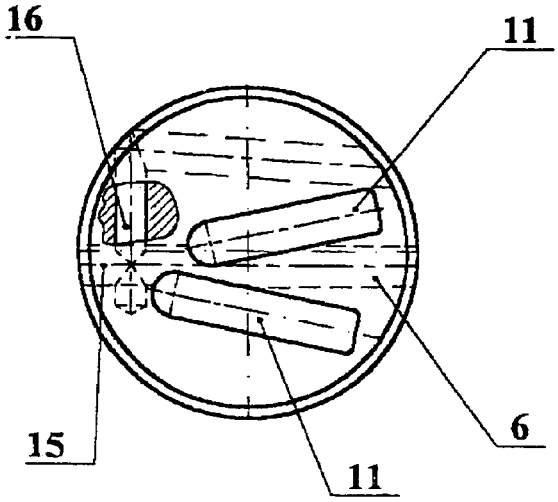
Figure 3A:
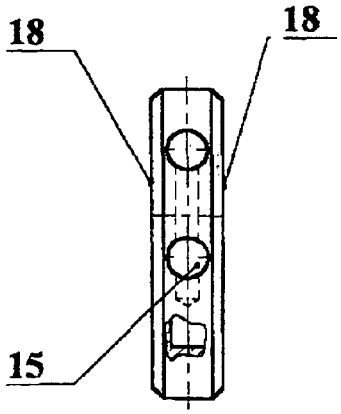
Figure 3B:
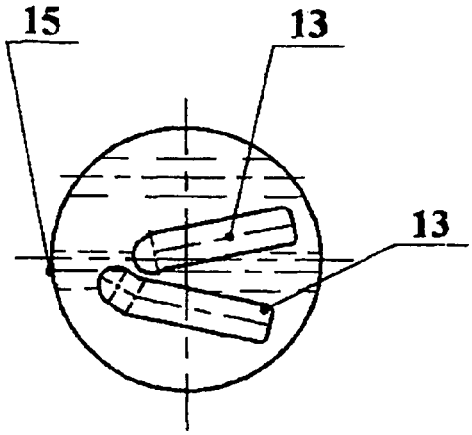
Figure 2:
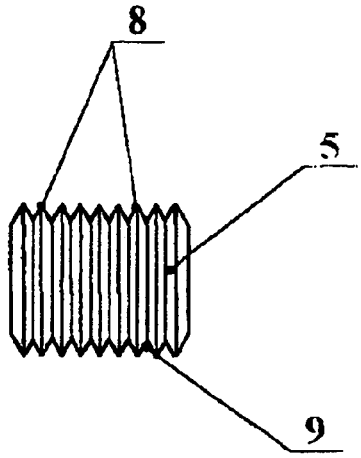
Figure 3C:
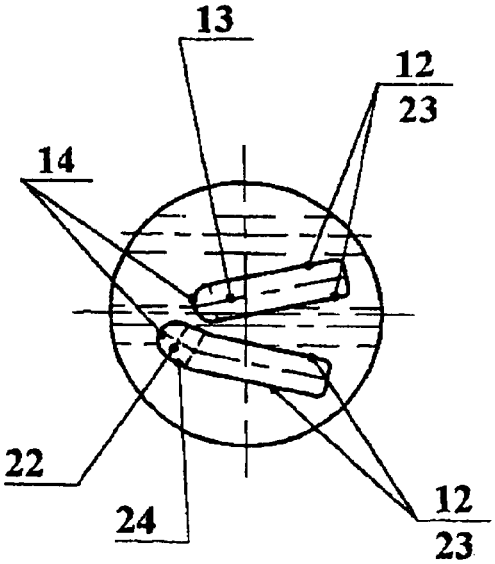
Figure 3D:
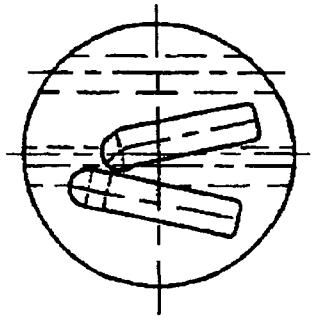
Figure 6A:
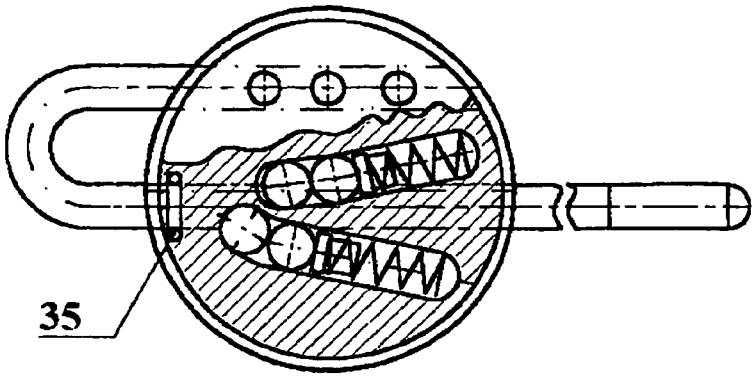
Figure 6B:
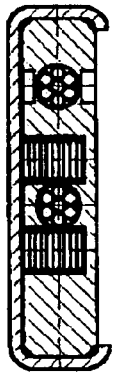
Figure 7A:
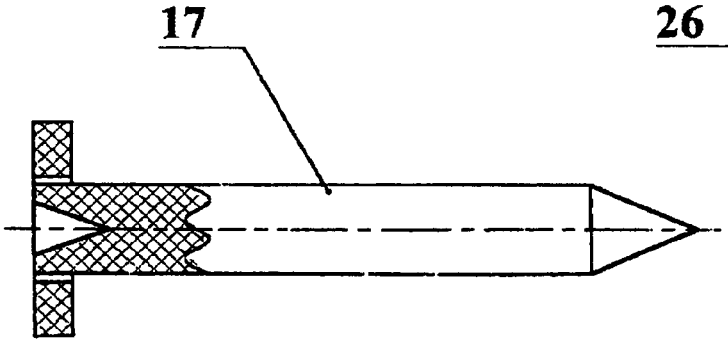
Figure 7B:
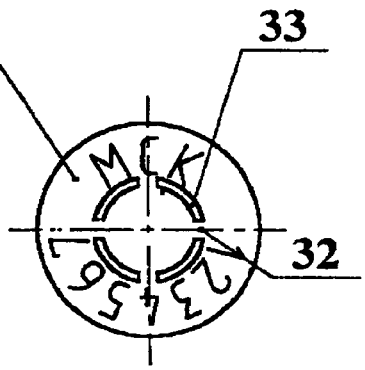
Figure 8A:
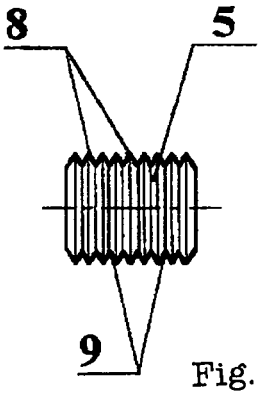
Figure 8B:
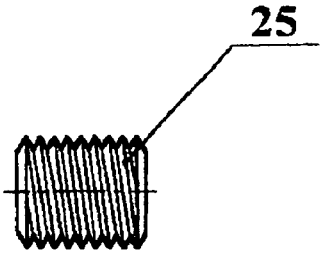
Figure 9A:
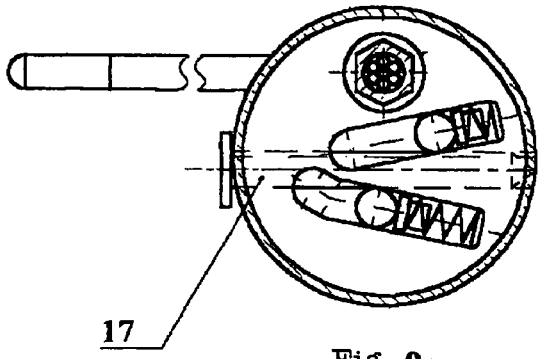
Figure 9B:
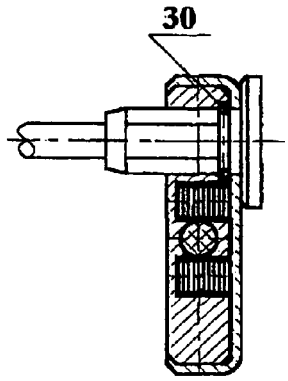
Figure 10A:
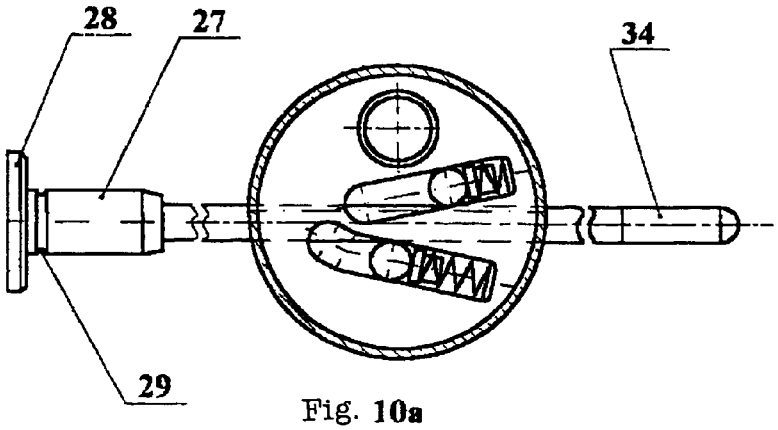
Figure 10B:
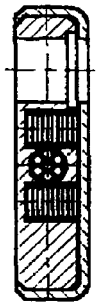
Figure 11A:
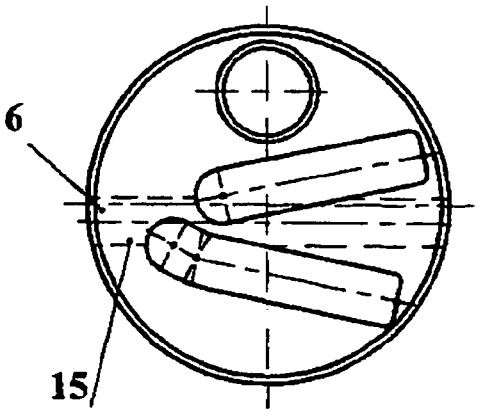
Figure 11B:
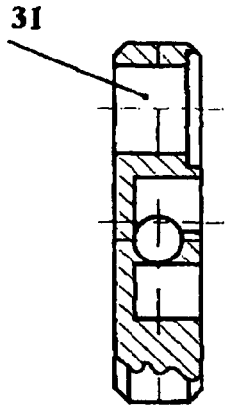
Figure 12A:
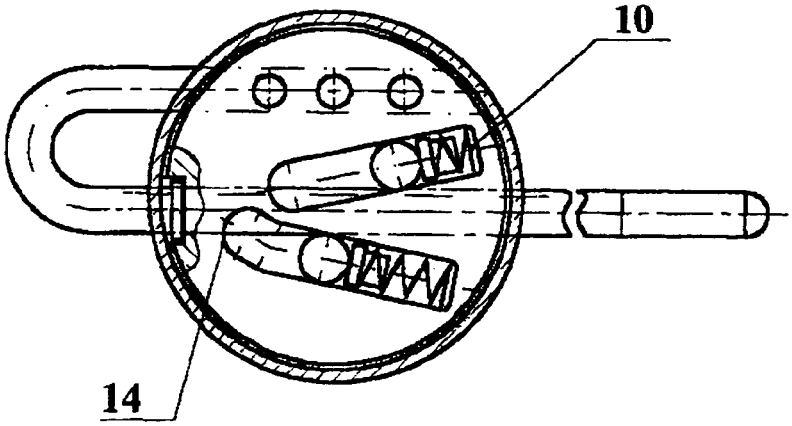
Figure 12B:
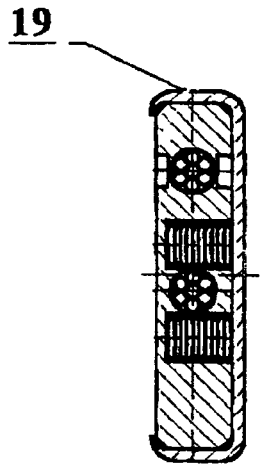
Figure 13A:
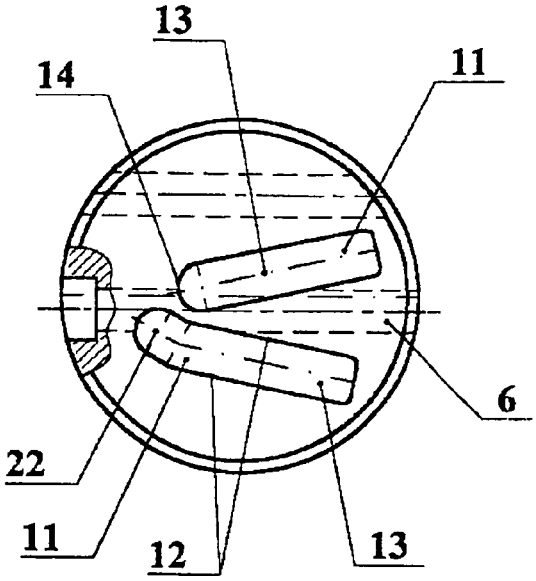
Figure 13B:
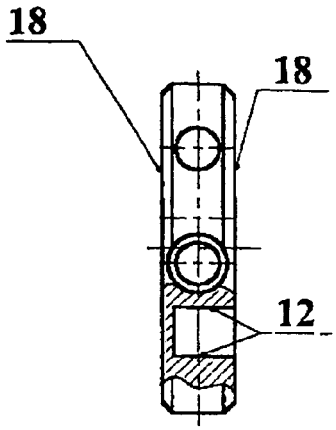
Figure 14A:
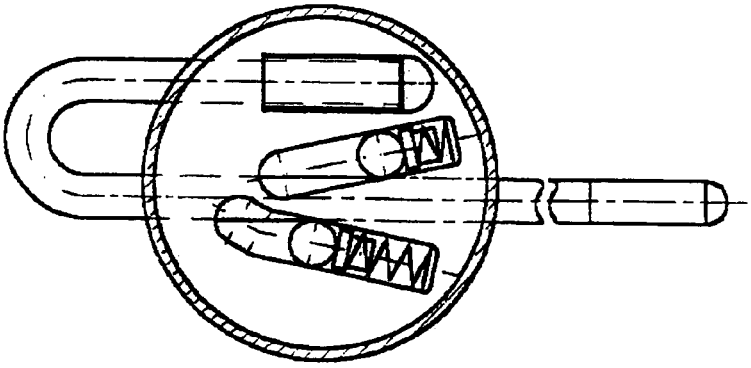
Figure 14B:
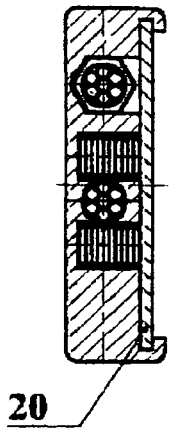

FIG. 1-3 it is shown the flexible locking and sealing device, described in first independent claim and dependent claims, and on FIG. 1 said device is shown in a locked state (the lugs of the subject being locked are not shown); on FIG. 2 it is shown a roller, on FIG. 3*a* there are shown two views of the device body; on 3*b*, 3*c*, 3*d* there are shown the variants of making the longitudinal slots for the rollers in the body in the specific cases of making the device; on FIGS. 4, 5, 6, 9, 10, 12 and 14 it is shown the flexible locking and sealing device, described in independent claim 27 and dependent claims, in a locked state, when locking <<in line>> and when locking with forming a loop of the wire rope cut; on FIG. 7 it is shown a controller, on FIG. 8—the alternative variants of making the rollers; on FIG. 11 and FIG. 13 there are shown the alternative variants of the device body.

THE MODE FOR CARRYING OUT THE INVENTION

On FIG. 1 it is shown the flexible locking and sealing device in a locked state according the first embodiment. It comprises a wire rope cut 1, one end 2 of which beforehand is made fast to a body 3, and the second 4, free, when locking passes through the body 3 forming a loop and is fixed by two identical spring-loaded rollers 5, disposed in the body 3, as it is shown on FIG. 2. The body 3 is made flat with the cylindrical side surface. As it is shown on FIG. 3*a*, 3*b*, 3*c*, 3*d* in the body 3 on the side of its cylindrical side surface, it is made a through channel 6 for the placement of the part of the second 4 free end of the wire rope cut 1 during a locking operation. The device is provided with a spring-loaded stopper 7, which is disposed inside the body 3 for acting on the side surface of the part of the wire rope cut 1 disposed in the body 3 when locking and able to close the through channel 6 of the body 3 during withdrawal of the wire rope cut (for example, unsanctioned), when the spring-loaded stopper 7 falls into the through channel 6 and closes it. The diameter of each roller 5 is greater than the diameter of the wire rope cut 1. The external side surface of each roller 5 is made toothed and is formed by alternate annular collars and grooves. Each of the rollers 5 together with its spring-loading spring 10 is disposed inside the body 3 in an individual mounting seat. Each mounting seat for the rollers 5 is made in the form of a longitudinal slot 11, the width of which corresponds to the diameter of the roller 5. The side walls 12 of the longitudinal slots 11 are parallel. The longitudinal axes 13 of the slots 11 for the rollers 5 are disposed at an angle with respect to each other and at an angle to the longitudinal axis of the through channel 6 of the body 3. The slots 11 for the rollers 5 have stop end cylindrical surfaces 14, which are oriented to the input hole 15 of the body 3 and offset with respect to each other. The mounting seat for the spring-loaded stopper 7 is made in the form of a blind groove 16 in the body 3 on the side of the its side surface. The blind groove 16 acrosses the through channel 6 of the body 3. The direction of the teeth cutting which is formed by the annular collars 8 and grooves 9 on the external side surface of the rollers 5 can not coincide with the direction of twisting of the wire rope cut 1. Or the direction of the teeth cutting which is formed by the annular collars 8 and grooves 9 on the external side surface of the rollers 5 can coincide with the direction of twisting of the wire rope cut. The device according to the first and the second embodiments may be additionally provided with the controller 17, intended for holding the rollers 5 in the mounting seats 11 when assembling the device and preparing for use. The controller 17 is shown on FIG. 7. It is suggested to make it in the form of an oblong body of a cylindrical form, its diameter corresponds to the diameter of the wire rope cut 1, its length—to the length of the through channel 6 of the body 3. The controller 17 can be made from a plastic. The flat end surfaces 18 of the body 3 are parallel. As it is shown on FIG. 5, the device may be provided with a thin-walled jacket 19 and a cover 20, made fast to the body 3 for forming a one-piece construction, for example by flaring. The device can be provided only with the thin-walled jacket 19 without the cover. The thin-walled jacket is also made fast to the body 3 for forming a one-piece construction. It is possible to carry out the device so that it doesn't have the jacket 19 and the body 3 is provided with the cover 20, which when fixing on the body forms a one-piece construction. The necessary sealing information can be applied to the flat end surfaces 18 of the body 3, and/or the thin-walled jacket 19, and/or the cover 20. In the cross section, the body 3 can have the form of a circle or an oval or a polygon. The selection depends on client wishes, the conditions of exploitation and assists the expansion of the technical means assortment. Preferably, the alternate annular collars 8 and grooves 9 of the toothed side surface of the rollers 5 in the cross section can have a triangle form. Preferably, the beginning and the end of the teeth on the side surface of the rollers 5 would be formed by the bottom of the grooves 9. The stop end cylindrical surfaces 14 of the slots 11 for the rollers 5 in the body 3, which are oriented towards the input hole 15 of the body 3, are offset with respect to each other for a distance equal to the pitch of strands twisting of the wire rope cut 1. Preferably, the diameter of the spring-loaded stopper 7 corresponds to the diameter of the wire rope cut 1. Preferably, the longitudinal axis of the spring-loaded stopper 7 is perpendicular to the longitudinal axis of the part of the wire rope cut 1, disposed inside the body 3 when locking, i.e. to the longitudinal axis of the through channel 6 of the body 3. The device can be additionally provided by two pushers 21, each disposed in the corresponding longitudinal slot 11 and interacting with the side surface of the roller 5 on the one side and with the roller spring-loading spring 10. Preferably, when designing each specific device, its parameters are selected so that in a locked state each pusher 21 is disposed opposite to the roller 5, which in turn is disposed in the other slot 11, functioning as the stop for the wire rope cut 1 and excluding the sag of the bended part of the wire rope cut 1. These measures provide the increase in reliability of locking operation, decreasing on the one hand the ability of reverse withdrawal of the wire rope cut 1 from the body 3 during criminal attempt, and on the other hand—increasing the interaction forces of the rollers 5 with the side surfaces of the wire rope cut 1. According to the invention there are suggested several possible variants of the arrangement of the longitudinal slots 11 for the rollers 5 with respect to each other and with respect to the through channel 6 of the body 3. Thus, an angle at which the longitudinal axis 13 of the slot 11 for the roller 5, disposed closer to the input hole 15 of the body 3, is arranged can be greater than an angle at which the longitudinal axis 13 of the other slot is disposed. And an angle, at which the longitudinal axis of the slot for the roller 5 disposed closer to the input hole 15 of the body 3, is arranged may be less than the angle at which the longitudinal axis 13 of the other slot 11 is disposed. And the angles at which the longitudinal axes 13 of the slots 11 for the rollers 5 are disposed with respect to the longitudinal axis of the through channel 6 of the body 3 can be equal. Besides, the longitudinal axis of the part 22 of one slot 11 for the rollers 5 or the parts of each of longitudinal slots 11 for the rollers 5, having the stop end cylindrical surface 14, can be made at an angle with respect to the longitudinal axis of the other part of the longitudinal slot 11. The length of the part 22 of the longitudinal slot 11 with the stop cylindrical end surface 14, which is disposed at an angle to the other part of this longitudinal slot 11, is selected from the conditions of providing the combination of maximal force of the rollers 5 to the wire rope cut and minimal dimensions of the body 3 and, respectively, of the whole device. The stop end cylindrical surfaces 14 of the slots 11 in the body 3, which are oriented towards the input hole 15 of the body 3, are offset with respect to each other for the distance providing the prescribed radius of the curve of a part of the wire rope cut 1 in the body when locking.

According to the second embodiment of the invention, shown on FIGS. 4-6, 12 and 14 in a locked state with forming a loop, on FIG. 10—in line, a flexible locking and sealing device comprises a wire rope cut 1 which when locking passes through a channel 6 of a body 3 and is fixed by several spring-loaded rollers 5, disposed in the mounting seats, provided in the body 3. The mounting seats for the rollers 5 are made in the form of two longitudinal slots, which are disposed on two diametrically opposite sides of the through channel 6 and are able to communicate with the space of the through channel 6. Two longitudinal slots 11 have the stop end surfaces 14, which are offset with respect to each other and with respect to the input hole 15 of the body 3. Both slots 11 are inclined to the through channel 6 of the body 3 and the angles of their inclination are oriented to the input hole 15 of the body 3. The spring-loaded by the springs rollers 5 are disposed in the slots 11 able to rotate and move along the slots 11 when locking and are able to come up against the stop end surfaces 14 of the slots 11 by their side surfaces when a criminal reverse withdrawal of the wire rope cut from the body takes place. It is proposed to make the stop end surfaces 14 of the slots 11 in the form of a part of a cylindrical surface, the diameter of which either corresponds to the diameter of the rollers 5 or is greater than it. The sides surfaces 23 of one slot 11, disposed farther from the input hole 15 of the body 3, are made flat, rectilinear and parallel to each other, and the side surfaces of the other slot 11, disposed closer to the input hole 15 of the body 3, are also flat and parallel, and consist from two parts 23 and 24, disposed at an angle with respect to each other so that the part 24 of this slot 11, at the end of which there is., the stop end surface 14, is inclined to the through channel 6 of the body 3 more than the other part 23 of this slot 11. I.e., it can be said, that the side surfaces 23 and 24 of the slot 11, with the stop end surface 14 on its end, are inclined to the longitudinal axis 13 of the through channel 6 of the body 3. As it is shown on FIG. 8, the external side surface of each roller 5 can be made either in the form of a spiral surface 25 or it can be formed by alternate annular sharpened collars 8 and grooves 9, the cross section plane of which are parallel to each other and are inclined to the longitudinal axis of the roller 5. Preferably, this angle of inclination corresponds to the twisting angle of individual strands of the wire rope cut 1. Each pusher 21 is disposed in the corresponding slot 11 and interacts on the one side with the side surface of corresponding roller 5 and on the other side—with the roller spring-loading spring. As it is shown on FIG. 9 the device prepared for locking may be provided by a controller 17, which is shown on FIG. 7. The controller 17 is suggested to be made in the form of a cylindrical body, one end of which is sharpened, and the second can have a cap 27, able to be easy separated from the cylindrical body of the controller 17. After breaking-off the cap 27 from the controller body remains the ring-shaped element on the surface of which it is possible to apply the control and sealing information, it can be used as a break-off sealing element, which is enclosed to the protocol of the opening during the sunctioned locking. In order to facilitate the manufacture of the device technology the slots 11 for the rollers 5 can be made opened at one from two end surfaces 17 of the body 3. For increasing the convenience of exploitation the end surfaces 18 of the body 3 are preferably made flat. The total number of the rollers 5 in each specific device is selected from the expression <<n+1>>, where $n \geqq 1$. This number is selected depending on the specified forces of locking and device dimensions. The use of three rollers and more in the device of specified dimensions instead of two rollers—makes for the increase in the clamping forces of the wire rope cut 1 and increases the force characteristics of the device. The diameter of each of the rollers 5 can correspond to the diameter of the wire rope cut 1 or exceed it. In case of carrying out the device with three rollers, two rollers 5 disposed in different slots are disposed opposite each other so that the plane passing through the central axes of these two rollers 5 is perpendicular to the longitudinal axis of the through channel 6 of the body 3. Such variant of making the device with three rollers is possible, when two rollers 5 disposed in different slots opposite each other can have an equal diameter, and the diameter of the third roller 5, which interacts by its side surface with the stop end surface 14 of the slot 11, disposed closer to the input hole 15 of the body 3, is less than the diameter of these two rollers 5. This favours the expansion of the technical means arsenal.

It is possible to make the device as it is shown on FIG. 4, 5, 6, 12, 14 when one end 2 of the wire rope cut 1 is beforehand rigidly fastened inside the body 3 and the second free 4 is intended for passing when locking through the lugs or the loops of the device being locked (not shown on fig.) and, respectively, through the channel 6 of the body 3 for fixing the part of the wire rope cut 1 by means of the rollers 5 disposed in the body 3.

It is possible to make the device as it is shown on FIG. 10, when one end of the wire rope cut 1, not intended for fixing inside the body 3 when locking, is provided by a tip 27, which has a head 28 with flat end surface. On the external surface of the tip's body it can be made an annular groove 29. The annular groove 29 can be used for the placement of a split ring 30.

When using the device for locking <<in line>> the head 28 of the tip 27 can be used as a sealing element, i.e. the necessary sealing information can be applied to it.

Figure 4:
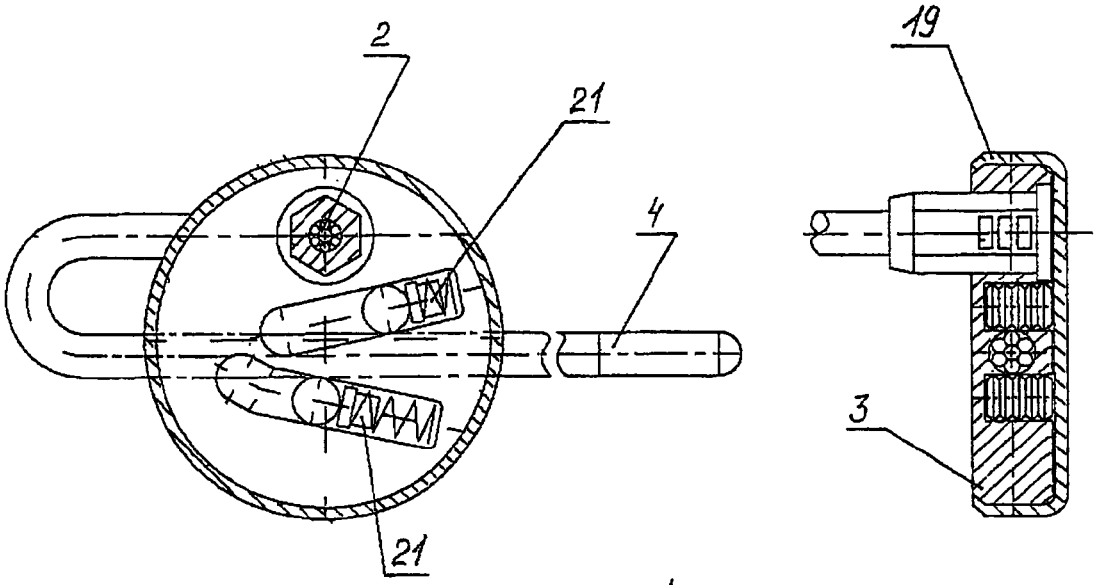
Figure 5:
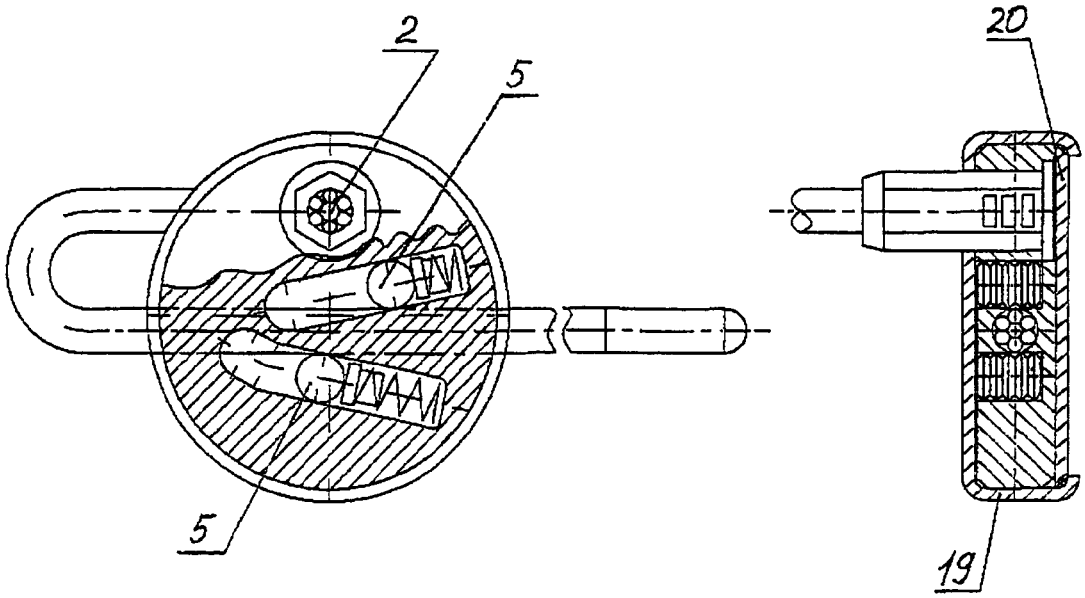

When using the device for locking the objects with forming a loop the tip 27 with the fixed wire rope cut 1 end can be disposed inside the body 3 as it is shown, for example, on FIG. 4, 5. For disposing the tip 27 in the body 3, there is a through channel 31 in the body 3. Preferably, the longitudinal axis of the through channel 31 would be perpendicular to the longitudinal axis of the through channel 6 of the body 3. For excluding the ability of the turning of the tip 27 inside the body 3, the tip 27 in its cross section has the polygon form, similar to the form of the through channel 31 in the body 3.

When using the device for locking the objects with forming a loop one end 2 of the wire rope cut 1 is beforehand rigidly fastened inside the body 3 (without using the tip 20, as it is shown, for example, on FIG. 6, 12, 14). And the longitudinal axis of this end 2 of the wire rope cut 1 and the longitudinal axis of the through channel 6 of the body 3 are disposed in one plane and they may be parallel to each other or disposed at an angle to each other.

The angles of inclination of both slots 11 to the through-channel 6 of the body 3 can be equal or different, i.e. one can be greater or less than other. Under the angle of inclination of one of the slots 11, the side surfaces of which consist from two parts disposed at an angle with respect to each other, it is understand the angle of inclination of its main longitudinal part, i.e. not having the stop end surface 14, and which is intended for disposing the roller 5 (or rollers), the spring 10 and the pusher 21.

The diameter of the cylindrical oblong body of the controller 17 can correspond to the diameter of the wire rope cut 1 or can be less, and its length corresponds to the length of the through channel 6 of the body 3. The cap 26 of the controller 17 for facilitating the separation can be connected with its cylindrical body by means of thin-walled cross pieces formed due to the slots made between the cap and the cylindrical body of the controller. The cap of the controller is made able to apply to it the necessary sealing information.

The edges of spiral 25 and annular collars 8 on the external surface of the rollers 5 are preferably sharpened for better insertion into the body of the wire rope cut during the locking operation. Preferably, in any embodiment of the device in a locking state at least one roller 5 is able to enter inside the wire rope cut 1 on the depth not less than the half of its diameter. It is provided by usual constructive calculation in each concrete case of making of the device.

For increase in convenience the body 3 is preferably made flat, i.e. so that its thickness, which is determined in general by the height of the rollers 5 and the diameter of the wire rope cut 1, will be much less than its diameter (the cross size).

Preferably, the stop end surfaces 14 of the longitudinal slots 11 for the rollers 5 are offset with respect to each other for a distance corresponding to the diameter of the rollers 5 or this distance can be slightly less than the diameter of the rollers 5.

As it is shown on FIG. 1, 4, 6, 9, 10, 12 the devices according to the first and the second embodiments can be provided with a thin-walled jacket 19, which protects the body 3. The thin-walled jacket 19 is made fast to the body 3 forming a one-piece construction, for example, by means of expansion.

In both embodiments the devices can be provided with the thin-walled jacket 19 and a cover 20 (as it is shown, for example, on FIG. 5), which also protect the body 3 and form a one-piece construction.

It is also possible to provide the devices in both embodiments (as it is shown, for example, on FIG. 14) only with the cover 20, made fast to the body 3 and forming a one-piece construction, without the jacket.

The place for applying the sealing information can be provided on the external surface of the body 3, and/or on the external surface of the thin-walled jacket 19, and/or on the external surface of the cover 20, and/or on the surface of the cap 26 of the controller 17, and/or on the head 28 of the tip 27.

One end 4 of the wire rope cut 1 intended for passing through the body 3 during a locking operation can be provided with a sharpened cap 34 which is made fast to the end of this wire rope cut 1, fixing the individual strands of the wire rope cut 1 and the wires from untwisting and fluffing. The places of communication of the slots 11 with the through channel 6 of the body 3 are located in close proximity to the stop end surfaces 14 of the slots 11.

Preferably, the rollers 5 are arranged in the slots 11 of the body 3 in such a way that the rotation axes of the rollers 5 should be parallel to each other and at the same time they should be perpendicular to the longitudinal axis of the through channel 6 of the body 3. In order to facilitate the rolling of the rollers 5 in the slots 11 the bottom surface of these slots in the body 3 can be made flat. The cross section of the body can have the form of a circle or the form of a polygon.

Inside the body 3 on the side of its input hole 15 it is disposed a ring-shaped element 35, intended to prevent a criminal penetration into the body 3. The ring-shaped element 35 can be made in the form of a washer or a ring, the internal diameter of which is selected depending on the diameter of the wire rope cut 1 providing the minimal clearances and made from a material with the increased hardness, for example, from hardened by heat treatment steel 40C. For facilitating production procedures and techniques the slots 11 for the rollers 5 in the body 3 can be made opened on the side of the flat surface of the body 3. The end surfaces 36 of the slots for the rollers 5 opposite to their stop end surfaces 14 can be made curvilinear for the increase in stroke of the spring 10 with the pusher 21. The pitch of the spiral thread (of the surface) 25 or the pitch of the ring-shaped collars 8 and grooves 9 on the side surface of the rollers 5 corresponds to the diameter of the individual wires in the strands of the wire rope cut 1. This increases the force interaction of the rollers 5 with the wire rope cut 1.

It is also possible to make the device so as it shown on FIG. 6, where the part of a slot 11, disposed farther from the input hole 15 of the body 3, has a bend from the rest rectilinear part of this slot, directed from the wire rope cut 1 or parallel to the wire rope cut 1 disposed in the body 3 during a locking operation, i.e. parallel to the through channel 6 of the body 3. In such a case it is expedient to use 3 or 4 rollers 4.

The data of the experiments have shown that the simulating attempts of the criminal effect upon the wire rope cut 1 by means of its reverse withdrawal, tapping etc. from the body 3 even in case of applying the loads equal 2 tons and greater were unsuccessful. The wire rope cut 1 had not been destroyed and remained fixed by the rollers 5 which came up against the stop end surfaces 14 of the slots 11.

But by means of constructional analysis and the selection of the dimensions of the elements of the device it is possible to specify and to ensure the normalized index of rupture of the wire rope cut 1 during the criminal action. In this case the rollers 5, arranged in the slots 11 (preferably in the slot which is disposed farther from the input hole 15 of the body 3) will not touch the stop end surfaces 14 of the slots 5, which will not play the role of the stops for the rollers 5 during a criminal action. This can be used when it is necessary to check in good time the attempt of criminal effect on the device, and the destroyed wire rope cut 1 will indicate it directly.

THE EXPLOITATION IN INDUSTRY

According to the first embodiment of the invention the flexible locking sealing device is used in the following way. Beforehand, in the mounting seats 11 in the body 3 the rollers 5 are arranged together with the springs 10 and the pushers 21, and are fixed there by means of the controller 17. During the locking operation the sharpened and optionally provided with the cap 34 end 4 of the wire rope cut 1 in inserted into the body 3 through its input hole 15, interacts with the end of the controller 17 and gradually pushes it out from the body 3. When the wire rope cut 1 passes through the body 3, at first one of the rollers 5, disposed closer to the input hole 15 of the body 3, interacts with the side surface of the wire rope cut 1, providing fast bond to the wire rope cut 1. Then the second roller 5 interacts with the side surface of the wire rope cut 1, already bonded to the first roller 5, making the final locking and tightening of the wire rope cut. The final tightening of the wire rope cut 1 is completed during its passing through the body 3 and exiting from it. In case of use of spring-loaded stopper 7 after the locking operation it comes up against the side surface of the wire rope cut 1.

The proposed construction of the rollers 5, their arrangement in the body 3 and their relative arrangement provide for fast and reliable bond between the rollers and the wire rope cut 1, makes for the increase in the force of interaction of the rollers 5 with the wire rope cut 1 and allows the maximal use of strength parameters of the wire rope cut 1 while making the flexible locking sealing devices with minimal dimensions. The proposed arrangement of the rollers 5 inside the body 3 during the attempt of criminal action (reverse withdrawal of the wire rope cut 1 from the body 3) makes for the increase in force interaction between the wire rope cut 1 and the rollers 5, thus increasing the reliability of locking. In each embodiment of the invention the best use of the force characteristics of the wire rope cut 1 takes place. In contrast to the prior art, it is impossible to predict the place of the wire rope cut 1 failure when unsanctioned opening takes place, since the wire rope cut 1 is not bitten through but is crushed, worn out, destroyed thus forming nonuniform strands. It is impossible to re-use thus destroyed the wire rope cut.

The use of the rollers 5 with the toothing external side surface, formed by alternate annular collars 8 and grooves 9, the edges of which can be sharpened and have a triangle form, is directed to the improved bond between the rollers 5 and the side surface of the wire rope cut 1, which decrease the length of withdrawal of the wire rope cut 1 during a criminal action, since the sharpened collars 8 cut deeply into the side surface of the wire rope cut 1, to a depth of not less than the half of the diameter of the wire rope cut 1. This also makes for the increase in the reliability of the device.

The sanctioned opening of the flexible locking sealing device is carried out by biting through the wire rope cut 1 with a special tool ( ), after that the wire rope cut 1 is easily withdrawn from the body 3. The re-locking of the device is excluded since the rollers 5 and the spring-loaded stopper 7 after the withdrawal of the wire rope cut 1 from the body 3 are displaced and close the through channel 6 of the body 3. Since the slot 16 for the stopper 7 intersects the through channel 6 of the body 3, in case of withdrawal of the wire rope cut 1 from the body 3 the stopper 7 closes the through channel 6 of the body 3, which additionally excludes the re-insertion of the wire rope cut 1 into the body 3. After the withdrawal of the wire rope cut 1 from the body 3 it is impossible to return the rollers 5, their springs 10, the spring-loaded stopper 7 to their mounting seats, and, consequently, it is impossible to make the unsanctioned repeated locking of the device. These measures allow to establish a fact of a criminal opening of the device easily and fast, thus providing the additional degree of protection and reliability.

According to the second embodiment of the invention, beforehand the rollers 5 with their springs 10 and pushers 21 are disposed in the mounting seats 11 in the body 3 and are fixed there by means of the controller 17. During the locking operation one end 4 of the wire rope cut 1 optionally with the sharpened cap 34 is inserted into the body 3 through its input 15, interacts with the end of the controller 17 and gradually pushes it out from the body 3. When the wire rope cut 1 passes through the body 3, at first one of the rollers 5, disposed closer to the input hole 15 of the body 3, interacts with the side surface of the wire rope cut 1, providing fast bond to the wire rope cut 1. Then the second roller 5 interacts with the side surface of the wire rope cut 1, already bonded to the first roller 5, making the final locking and tightening of the wire rope cut. The final tightening of the wire rope cut 1 is completed during its passing through the body 3 and exiting from it. In case of use of spring-loaded stopper 7 it comes up against the side surface of the wire rope cut 1, providing its additional fixation.

The proposed and described construction of the rollers 5, their arrangement in the body 3 and their relative arrangement provide for fast and reliable bond between the rollers and the wire rope cut 1, makes for the increase in the force of interaction of the rollers 5 with the wire rope cut 1 and allows the maximal use of strength parameters of the wire rope cut 1 while making the flexible locking sealing devices with minimal dimensions. The proposed arrangement of the rollers 5 inside the body 3 during the attempt of criminal action (reverse withdrawal of the wire rope cut 1 from the body 3) makes for the increase in force interaction between the wire rope cut 1 and the rollers 5, thus increasing the reliability of locking. The roller 5 which is disposed farther from the input hole 15 of the body 3 (in the slot 11, the stop end surface 14 of which is disposed farther from the input hole 15 of the body 3) in the locked state of the device bends the wire rope cut, increasing the friction during a criminal action and thus preventing the reverse withdrawal of the wire rope cut 1 from the body 3.

In each embodiment of the invention the best use of the force characteristics of the wire rope cut 1 takes place. In contrast to the prior art, it is impossible to predict the place of the wire rope cut 1 failure when unsanctioned opening takes place, since the wire rope cut 1 is not bitten through but is crushed, worn out, destroyed thus forming nonuniform strands. It is impossible to re-use thus destroyed the wire rope cut.

The use of the rollers 5 with the toothing external side surface, formed by alternate annular collars 8 and grooves 9, the edges of which can be sharpened and have a triangle form, is directed to the improved bond between the rollers 5 and the side surface of the wire rope cut 1, which decrease the length of withdrawal of the wire rope cut 1 during a criminal action, since the sharpened collars 8 cut deeply into the side surface of the wire rope cut 1, to a depth of not less than the half of the diameter of the wire rope cut 1. This also makes for the increase in the reliability of the device.

The sanctioned opening of the flexible locking sealing device is carried out by biting through the wire rope cut 1 with a special tool ( ), after that the wire rope cut 1 is easily withdrawn from the body 3. The re-locking of the device is excluded since the rollers 5 and the spring-loaded stopper 7 after the withdrawal of the wire rope cut 1 from the body 3 are displaced and close the through channel 6 of the body 3. Since the slot 16 for the stopper 7 intersects the through channel 6 of the body 3, in case of withdrawal of the wire rope cut 1 from the body 3 the stopper 7 closes the through channel 6 of the body 3, which additionally excludes the re-insertion of the wire rope cut 1 into the body 3. After the withdrawal of the wire rope cut 1 from the body 3 it is impossible to return the rollers 5, their springs 10, the spring-loaded stopper 7 to their mounting seats, and, consequently, it is impossible to make the unsanctioned repeated locking of the device. These measures allow to establish a fact of a criminal opening of the device easily and fast, thus providing the additional degree of protection and reliability.

The side surfaces of the bended part of the slots 11 can have the curvilinear form, sufficient for providing the guiding and insertion the roller 5 into the wire rope cut 1 during an unsactioned opening by means of the reverse withdrawing of the wire rope cut 1 from the body 3.

Thus, the technical result of the invention is provided by the combination of its features, each carrying out its function and solving the problem in combination.

The invention claimed is:

1. A flexible locking sealing device comprising a wire rope cut which during a locking operation passes through a channel in a body and is fixed there by several spring-loaded rollers, disposed in mounting seats provided in the body and interacting by side surfaces of the rollers with a side surface of the wire rope cut when locking, the mounting seats are made in the form of two longitudinal slots, disposed on two diametrically opposite sides of a through channel of the body, the slots being able to communicate with a space of the channel and having stop end surfaces offset with respect to each other and to an input hole of the body, both slots are inclined with respect to the through channel of the body and the angles of their inclination are directed towards the input hole of the body, the spring-loaded rollers are disposed in the slots able to rotate and move along the slots when locking and able to come up against the stop end surfaces of the slots by the side surfaces of the rollers when a reverse withdrawal of the wire rope cut from the body takes place; wherein the slot, the stop end surface of which is disposed farther from the input hole of the body, has side surfaces that are made flat, rectilinear and parallel to each other, and wherein the other slot, the stop end surface of which is disposed closer to the input hole of the body, has side surfaces that are made flat and consisting from two parts, so that one part of said other slot, having the stop end surface, is disposed at a greater angle with respect to the through channel of the body than the second part of this slot; the external side surface of each roller has a spiral form or is formed by alternate annular sharpened collars and grooves, the cross section planes of which are parallel to each other and inclined with respect to the longitudinal axis of the roller; besides the device is provided with two pushers each disposed in the slot for the rollers and each pusher interacting on one side with the side surface of the corresponding roller, and on the other side—with the roller spring-loading spring; besides, the device is provided with a controller made in the form of a cylindrical body, one end of which is sharpened.

2. The flexible locking sealing device according to claim 1, wherein the slots for the rollers are open on one end surface of the body.

3. The flexible locking sealing device according to claim 1, wherein the number of rollers is selected from the expression <<n +1>>, where n≧1.

4. The flexible locking sealing device according to claim 1, wherein the diameter of each of the rollers corresponds to the diameter of the wire rope cut or is greater than this diameter.

5. The flexible locking sealing device according to claim 1, wherein there are three rollers, two rollers arranged in different slots are disposed opposite each other so, that the plane passing through the central axes of these two rollers is perpendicular to the longitudinal axis of the through channel of the body.

6. The flexible locking sealing device according to claim 1, wherein one end of the wire rope cut is beforehand rigidly fixed inside the body, and the second free end in intended for passing through the channel of the body when locking and fixing by means of the rollers disposed in the body.

7. The flexible locking sealing device according to claim 1, wherein one end of the wire rope cut which is not intended for fixing inside the body when locking, is provided with a tip having a head with a flat end surface.

8. The flexible locking sealing device according to claim 7, wherein there is an annular groove on the external side of the tip close to its head.

9. The flexible locking sealing device according to claim 8, wherein the annular groove is intended for the location of a split ring.

10. The flexible locking sealing device according to claim 7, wherein when locking <<in line>> the head of the tip is a sealing element.

11. The flexible locking sealing device according to claim 7, wherein when locking with the forming of a loop the tip with the wire rope cut end fixed therein is disposed inside the body.

12. The flexible locking sealing device according to claim 11, wherein the body is provided with a through hole for the placement of the tip with the wire rope cut, the longitudinal axis of the through hole being perpendicular to the longitudinal axis of the through channel of the body.

13. The flexible locking sealing device according to claim 11, wherein in order to prevent the turning over of the tip inside the body the tip in its cross-section has a form of a polygon similar to the form of the through hole in the body where it is placed.

14. The flexible locking sealing device according to claim 1, wherein when locking with forming a loop a part of the one end of the wire rope cut, not intended for fixing inside the body, is beforehand rigidly fixed inside the body, the longitudinal axis of this part of the wire rope cut and the longitudinal axis of the through channel of the body are arranged in one plane and are parallel to each other or are located at an angle to one another.

15. The flexible locking sealing device according to claim 1, wherein the angles of inclination of both slots with respect to the through channel of the body are equal or different.

16. The flexible locking sealing device according to claim 1, wherein the diameter of an oblong body of the controller corresponds to the diameter of the wire rope cut or is less than this diameter, its length corresponds to the length of the through channel of the body, and a cap of the controller for facilitating the separation is connected with its cylindrical body by means of thinwalled cross pieces formed due to the slots made between the cap and the cylindrical body of the controller.

17. The flexible locking sealing device according to claim 16, wherein the cap of the controller is made so that it is possible to apply printing to the cap.

18. The flexible locking sealing device according to claim 1 wherein the edges of a spiral collars on the external surface of the rollers are sharpened.

19. The flexible locking sealing device according to claim 1, wherein in locked state of the device at least one roller is able to enter the wire rope cut to a depth of not less than a half of its diameter.

20. The flexible locking sealing device according to claim 1, wherein the body is made flat.

21. The flexible locking sealing device according to claim 1, wherein the end surfaces of the longitudinal slots for the rollers are offset with respect to each other within the distance corresponding to the rollers diameter or less.

22. The flexible locking sealing device according to claim 1, wherein it is provided with a thin-walled jacket which is made fast to the body.

23. The flexible locking sealing device according to claim 1, wherein the body is provided with a thin-walled jacket and a cover.

24. The flexible locking sealing device according to claim 23, wherein printing is provided on an external surface of the thin-walled jacket, or on an external surface of the cover, or on a surface of a cap of the controller, or on a tip head.

25. The flexible locking sealing device according to claim 1, wherein the body is provided with a cover.

26. The flexible locking sealing device according to claim 1, wherein one free end of the wire rope cut, intended for passing through the body during a locking operation, is provided with a sharpened cap which is made fast to the end of the wire rope cut, thus fixing the individual strands of the wire rope cut and the wires from untwisting.

27. The flexible locking sealing device according to claim 1, wherein the longitudinal axis of the part of a slot, disposed farther from the input hole of the body and having the stop end surface, is arranged at an angle with respect to the longitudinal axis of the other part of this slot, and this angle is less than an angle, at which the other part of this slot is arranged with respect to the longitudinal axis of the through channel of the body.

28. The flexible locking sealing device according to claim 1, wherein the places of communication of the slots for the rollers with the through channel of the body are located in close proximity to stop end surfaces of the slots.

29. The flexible locking sealing device according to claim 1, wherein the rollers are arranged in the slots of the body in such a way that their rotation axes are parallel to each other and are perpendicular to the longitudinal axis of the through channel of the body.

30. The flexible locking sealing device according to claim 1, wherein the bottom surface of the slots for the rollers in the body is flat.

31. The flexible locking sealing device according to claim 1, wherein inside the body on the side of its input hole a ring-shaped element is disposed, intended to prevent a criminal penetration into the body, this ring-shaped element is made from a material with the increased hardness and its internal diameter is selected in dependence from the wire rope cut diameter providing the minimal clearances.

32. The flexible locking sealing device according to claim 1, wherein in order to facilitate the manufacture technology the slots for the rollers are made opened on the side of the side surface of the body.

33. The flexible locking sealing device according to claim 1, wherein the end surfaces of the slots for the rollers opposite to their stop end surfaces, are made curvilinear for the increase in stroke of the spring with the pusher.

34. The flexible locking sealing device according to claim 1, wherein the pitch of the spiral thread or the pitch of the ring-shaped collars on the side surface of the rollers corresponds to the diameter of the individual wires in the strands of the wire rope cut.

35. The flexible locking sealing device according to claim 1, wherein the second end of the controller has a cap, able to be easily separated from the cylindrical body of the controller.

* * * * *